United States Patent [19]

Bloys

[11] Patent Number: 4,463,887

[45] Date of Patent: Aug. 7, 1984

[54] WOOD ASSEMBLY STAPLING AND BONDING APPARATUS

[76] Inventor: David W. Bloys, 4911 - 16th St., Lubbock, Tex. 79417

[21] Appl. No.: 405,924

[22] Filed: Aug. 6, 1982

[51] Int. Cl.[3] ..... B27F 7/06

[52] U.S. Cl. ..... 227/7; 29/432; 144/346; 144/353; 156/92; 156/350; 156/556; 227/14; 227/45; 227/100

[58] Field of Search ..... 144/344, 346, 353; 156/91, 92, 350, 556; 227/39, 44, 45, 99, 14, 7, 100; 29/432, 469.5

[56] References Cited

U.S. PATENT DOCUMENTS 4,025,028 5/1977 Jureit et al. ..... 227/7
4,289,554 9/1981 Reicherts et al. ..... 156/92
4,318,555 3/1982 Adamski et al. ..... 227/7
4,334,346 6/1982 Jensen ..... 227/45 X

*Primary Examiner*—Robert A. Dawson
*Attorney, Agent, or Firm*—Wendell Coffee

[57] ABSTRACT

Three elongated strips (called a web and two legs) are assembled into an elongated channel by a machine which includes a supply table. A stack of webs on the supply table feed downward by gravity. Legs are fed inwardly under the webs by pusher arms. The web and two legs are fed from the back to the front of the machine by a three-fingered lug on a continuous chain operated under the web magazine. Glue is applied to the top of the legs, then the web and two legs are pressed together over a spacer block, where they are stapled together to hold them in place until the glue sets.

4 Claims, 11 Drawing Figures

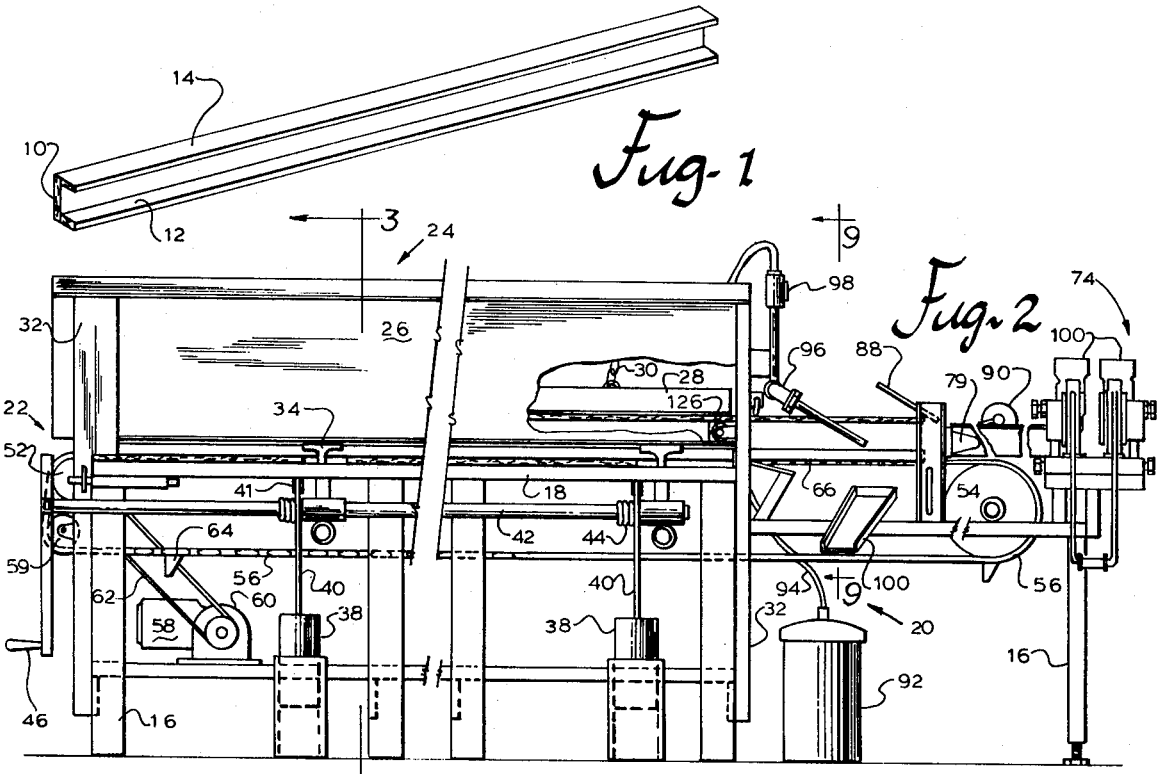
Fig. 1
Fig. 2
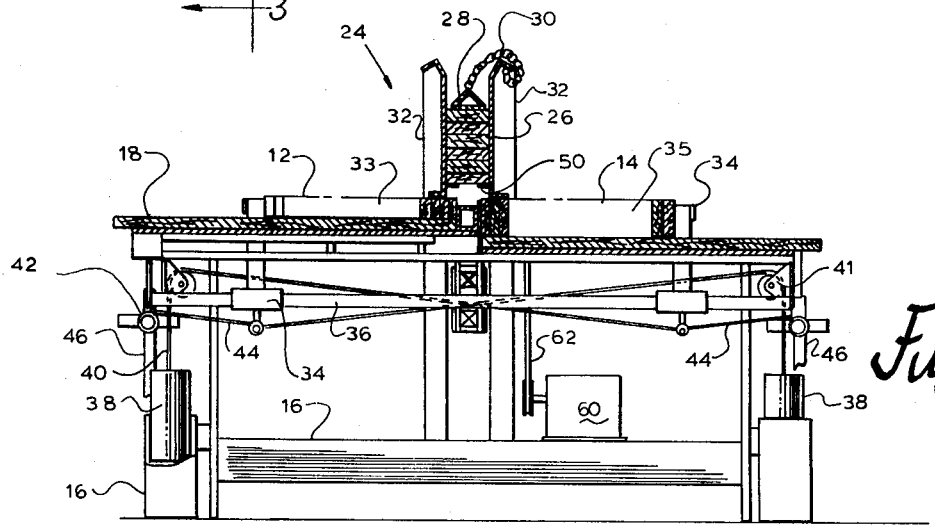
Fig. 3
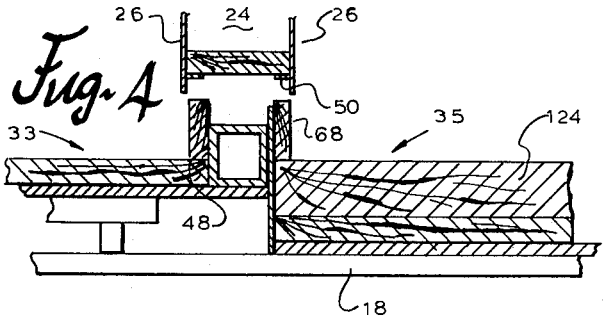
Fig. 4

WOOD ASSEMBLY STAPLING AND BONDING APPARATUS

BACKGROUND OF THE INVENTION (1) Field of the Invention

This invention relates to woodworking and more particularly to a machine for assembling three elongated strips of wood into a channel.

(2) Description of the Prior Art

With the popularity of waterbeds, there is an increasing demand for parts thereof. The waterbeds have side rails made of heavy wooden members. It is desired that these side rails have a padded cap over them. These padded caps are built around an elongated channel having a web and two legs. Therefore, there exists a considerable demand for the side rail caps and the elongated channel, which is an integral part thereof.

Before this invention, these channels were individually hand assembled.

Before this patent application was filed, the applicant caused a search to be made in the United States Patent and Trademark Office. The following patents were found:

BROWN, U.S. Pat. No. 1,174,965

FREDERICKSON ET AL, U.S. Pat. No. 1,646,645

JOA, U.S. Pat. No. 2,345,937

TROUTNER, U.S. Pat. No. 3,616,091

SAUDER, U.S. Pat. No. 3,928,097

JOA discloses a woodworking machine wherein a hopper full of flat wooden boards is fed by a drag chain. BROWN discloses a stapling machine for stapling cardboard boxes together.

FREDERICKSON ET AL discloses a wall board machine wherein battens or slats are fed along a flatbed and a coat of paper and glue is applied to the top and bottom of this series of wooden slats.

TROUTNER discloses a machine for making an I-beam from strips of wood. It appears that the machine is hand fed and the members are held together by glue.

Applicant does not consider SAUDER of interest. However, he reports it to the Examiner inasmuch as he has belief that it would be of interest to the Examiner since it was reported by an experienced patent searcher.

SUMMARY OF THE INVENTION (1) New and Different Function

I have invented an improved machine and method for assembling three strips of wood into the web and two legs of a finished channel. The two legs are fed on either side of a spacer block in the orientation of the finished product. The web is fed spaced above the legs so that glue can be applied to the top of the legs. Then the two legs are pressed against the spacer block and the web is pressed down on top of the glue, on top of the legs, at the spacer block. At the spacer block, staples are driven through the web into the legs to hold the parts together until the glue sets.

Thus it may be seen that the total function of my machine far exceeds the sum of the functions of the individual elements such as lugs, fingers, arms, etc.

(2) Objects of this Invention

An object of this invention is to make an elongated channel.

Further objects are to achieve the above with a device that is sturdy, compact, durable, lightweight, simple, safe, efficient, versatile, ecologically compatible, energy conserving, and reliable, yet inexpensive and easy to manufacture, install, adjust, operate and maintain.

Other objects are to achieve the above with a method that is versatile, ecologically compatible, energy conserving, rapid, efficient, and inexpensive, and does not require highly skilled people to install, adjust, operate, and maintain.

The specific nature of the invention, as well as other objects, uses, and advantages thereof, will clearly appear from the following description and from the accompanying drawing, the different views of which are not scale drawings.

BRIEF DESCRIPTION OF THE DRAWING

FIG. 1 is a perspective view of the channel to be made upon the machine.

FIG. 2 is a side elevational view of the entire machine foreshortened for purposes of illustration.

FIG. 3 is a sectional view through the supply table taken substantially on line 3—3 of FIG. 2.

FIG. 4 is an enlarged sectional detail view of the feed chain at the supply table taken on the same plane as FIG. 3.

DESCRIPTION OF THE PREFERRED EMBODIMENT

Figure 5:
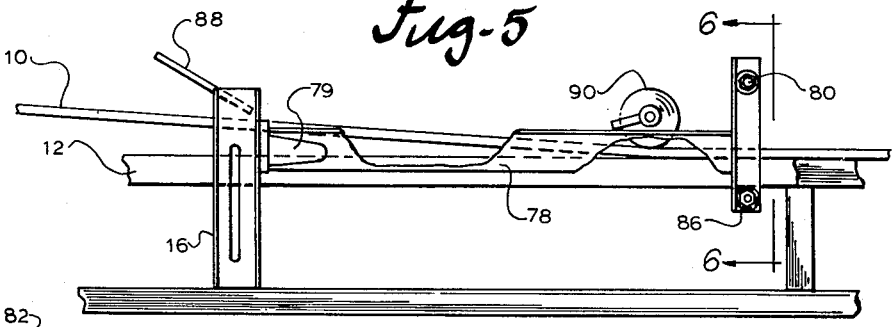
FIG. 5 is a side elevational view showing the pressure means for pressing the web and legs against the guide block with parts broken away for clarity of illustration.

Referring to the drawings and particularly to FIG. 1, there may be seen a channel according to this invention. The channel is composed of three elongated strips, the strips being made of pressed, adhered wood fiber product being a cellulose product rather than a natural wood product. However, each of the strips can be cut, nailed, stapled, or glued, like wood.

Figure 6:
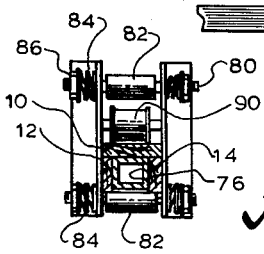
FIG. 6 is a sectional view taken of the pressure means taken substantially on line 6—6 of FIG. 5.
Figure 7:
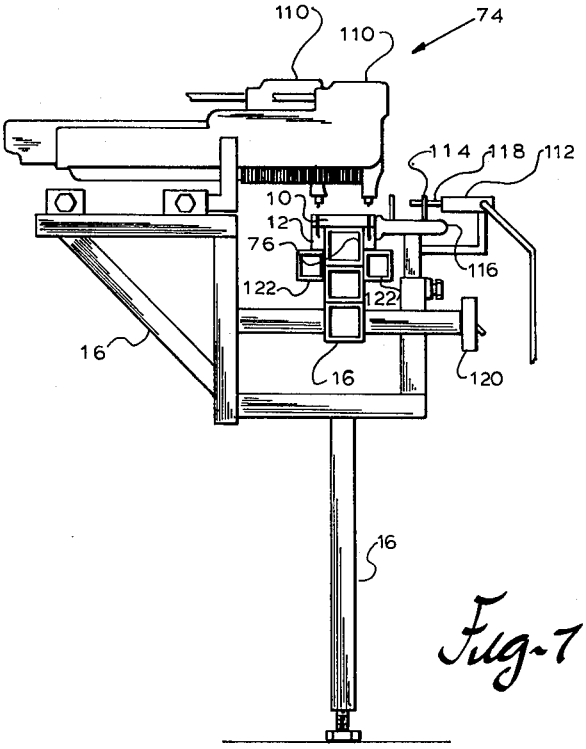
FIG. 7 is a front end elevation of the machine showing the staple guns, and showing the finished channel in section.
Figure 8:
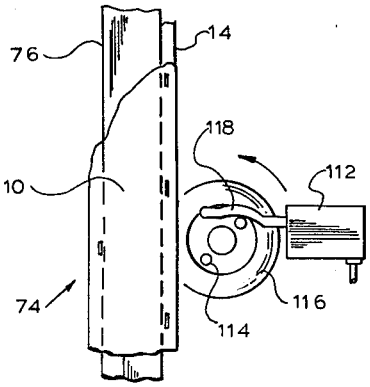
FIG. 8 is a top elevational view of the trigger wheel.
Figure 10:
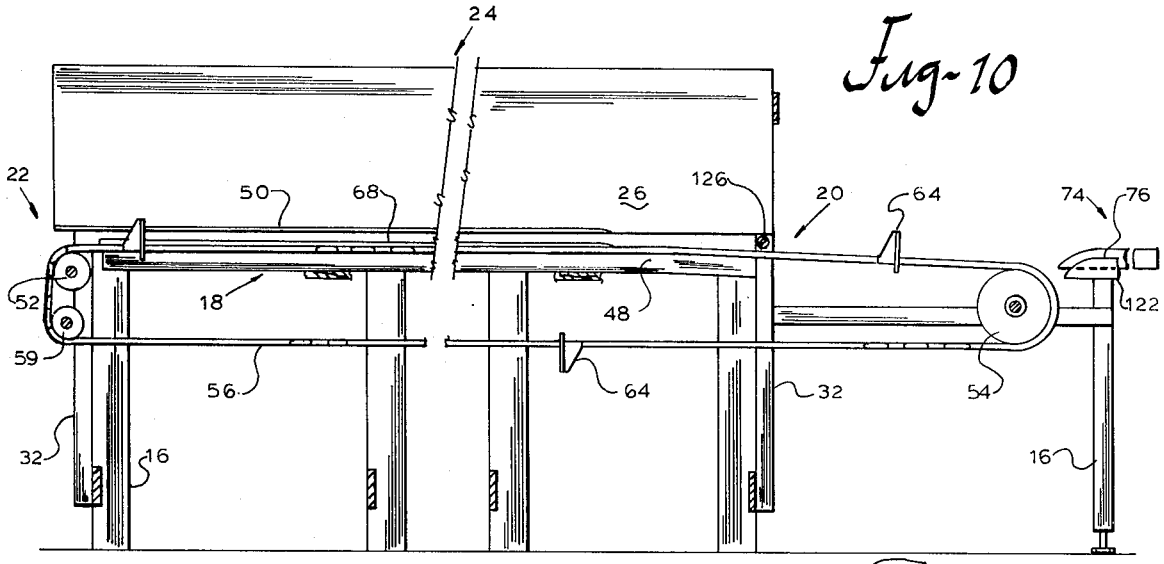
FIG. 10 is a longitudinal sectional view of the entire machine.
Figure 11:
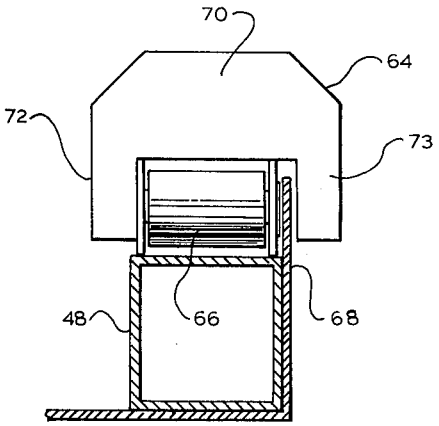
FIG. 11 is an enlarged section view of the lug and chain guide taken on the same plane as FIG. 4.
Figure 9:
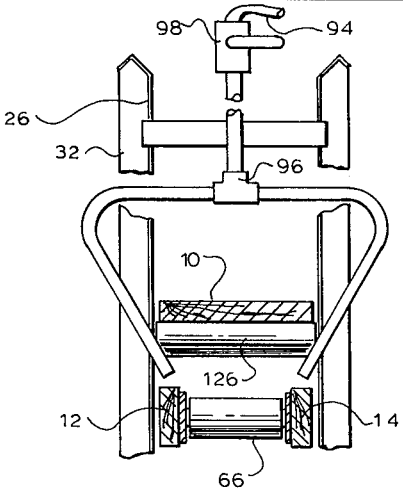
FIG. 9 is a sectional view showing the glue feed.

The channel will include web 10, regular leg 12, and long leg 14. As noted, one of the legs is called a long leg whereas it is shown in FIGS. 1, 3, 5, and 6 to be the same length as the regular leg 12. The length of the legs 12 and 14 are the distance from the web 10 and not the length of the strip or the channel. The important thing about long leg 14 is that the machine can be adjusted so that this leg can be of a different length than the regular length leg 12. The reason for this is that for the design of some waterbeds it is desired to have the cap extend further down the side rails than in other situations for the appearance of the waterbed.

The machine to make the channel includes main frame 16. Supply table 18 is a part of the main frame 16. The main frame 16 will have a front end 20 and a back end 22. The supply table 18 also has web magazine 24 extending along the center thereof. The web magazine 24 includes two vertical plates 26 which are spaced apart the approximate width of the web 10. Therefore, several pieces or strips which form the web, can be placed between the plates 26 by which the plates are fed by downward gravity. To aid in the positive feeding of the strips which will form the web 10, elongated weight 28, may be placed on top of them. The weight 28 movement into the web magazine 24 is limited by chains 30 attached to the top of the magazine 24. The plates 26 are held in place by stanchions 32, which are attached to the lower portion of the main frame 16.

The strips forming the legs 12 are placed upon a table in an area designated as leg magazine 33 on one side of the web magazine 24. The strips 14 forming the long leg placed on long leg magazine 35 on the other side of the web magazine 24. Strips on leg magazine 33 and 35 are pushed inward by arms 34. The arms are mounted upon guides 36. The guides 36 are attached to the main frame 16 below the supply table 18 and run traversely of the supply table, i.e. they run traversely of the length of the strips when the strips are in their magazine. The arms 34 are mounted for translational movement upon the guides 36. Each of the arms 34 are biased and moved by weight 38 attached to weight cable 40, which is attached to the arms 34 over pulley 41 on the opposite side of supply table 18 from the arm 34. The other end, the arm is also attached by take-up windlass 42, by windlass cable 44. The windlass cable 44 has a crank 46 and a rachet (not shown). In order to pull the arms 34 back to load more strips onto the leg magazine, the weights are pulled up by cranking upon the cranks 46, thus pulling the arms 34 back. A dog (not shown) is placed upon the ratchet (not shown) to hold the arms in this position. After the additional strips to form legs 12 and 14 have been placed on the leg magazines 33 and 35, the dog is released so that the arms 34 bear against the legs.

The inward movement of the legs are limited by table leg stop 48. The leg stop is located so that the outer edge of the legs is about even with the outer edge of the web 10, which will be in the approximate position when the channel is assembled. The downward movement of the web is limited by web stop 50 on the internal surface of each of the plates 26. This will position the web a short distance above the legs so that glue may be applied to the top of the legs as will be explained later.

Back sprocket 52 is journaled to the main frame 16 behind the supply table 18. Front sprocket 54 is journaled to the main frame 16 in front of the supply table 18. Feed chain 56 is continuous and is trained over the front sprocket 54 and back sprocket 52. Electric motor 58 drives the drive sprocket 59 through gear reducer 60 and belt 62. The total length of the feed chain 56 is longer than three times the length of the channel, i.e. three times the length of the webs 10. Therefore, three dogs or lugs 64 are placed upon the feed chain 56 at evenly spaced intervals.

The feed chain 56 has an upper run 66. The upper run 66 of the feed chain 56 is guided by chain guide 68 and leg stop 48 so that the upper run 66 is not only below the web magazine 24 but is between the legs 12 and 14 in the leg magazines 33 and 35. Each of the lugs 64 has three fingers thereon; web finger 70, regular leg fingers 72, and long leg finger 73. The long leg finger 73 is spaced from the feed chain 56 as shown. The chain guide 68 (in the form of a vertical plate) fits in the space between the finger 73 and chain 56 to guide the chain 56. The chain 56 rides on top the leg stop 48. Shortly before the front of the supply table 18, the leg stop 48 angles down and the chain guides 68 terminates. Thus at this point, the chain drops down.

The web finger 70 engages the back of a web 10 and each of the leg fingers 72 and 73 engages the back of one of the legs. Therefore two legs and one web are pushed forward each time a lug 64 comes to the back of the supply table 18. Since the spacing between the lugs is greater than the length of the web 10 and legs 12 and 14, there will be a space between the each of the channels as they are fed.

Stapler area 74 is attached to a main frame 16 on the front side 20 of the supply table 18. The staplers are forward of the front sprocket 54. Spacer block 76 is mounted on the main frame 16 at the stapler area 74. Basically, the spacer block 76 is in line with the leg stop 48. The stop 48 and block 76 are made of square metal tubing. As the web and legs are fed, the two legs will go on either side of the spacer block 76 and the web will go on top.

A leg pressure means 78 is mounted to the main frame 16 on each side of the spacer block 76. These are particularly shown in FIG. 5. They include an elongated structural element, such as a strap of metal extending from hinge 79 attached to the main frame 16 in front of the supply table to the spacer block 76. At the stapler area 74, they are mounted by spring pressure to press the each of the legs firmly against the spacer block. This is accomplished by having a bolt 80 extending into a block 82. A spring 84 is over the bolt on each side thereof and pushes against the press means 78 according to the position of nut 86. It is not necessary that the block 82 be fixed to anything and may float, inasmuch as the spacer block 76 will prevent the press means 78 from moving very much from one side to the other.

The web 10 is pressed downward by flap 88 which is mounted to the main frame 16 at a location of the hinge 79. Roller 126 at the front of the table 18 provides for smooth movement of the web 10. The web is further pushed down by web presser roller 90, which is located at the stapler area 74. The flap 88 and the web presser roller 90 form a web press means to securely press the web against glue upon the top of each of the legs.

Glue is applied to the top of the legs from glue pot 92, which is pressurized, thus forming a source of glue under pressure. Conduit 94 extends from the glue pot 92 and is bifurcated at 96 at an attachment to the main frame 16 at the front of the supply table 18. A valve 98 is located in the conduit 94 before the glue reaches the bifurcation 96. One of the terminals from the bifurcation 96 is located immediately above the regular leg 12 and the other terminal from the bifurcated conduit 94 is located to be immediately above the long leg 14. Therefore, it may be seen that when the valve 98 is open, the glue will be applied to each of the legs continuously as the legs are pushed from the supply table 18. Gutter 100 carries any excess or dripping glue away from the machinery.

Stapler gun 110 is located at the stapler area 74 over each of the legs above the web. When the staplers are actuated by trigger valve 112 the guns drive a staple through the web into the leg. The stapler is actuated by trigger fingers 114 extending up from the radial face of trigger wheel 116, which is journaled to the main frame 16 and bears against a leg. Therefore, it may be seen that if a leg is being fed past the trigger wheel 116, the trigger 116 will rotate causing the trigger finger 114 to trip the trigger or actuator 118 of the trigger valve 112. Every time the trigger valve 112 is actuated, this will actuate the stapler guns 110 to drive two staples as described above. Inasmuch as mechanics having ordinary skill can connect the air hoses from an air compresser to the trigger valve 112 and to the stapler guns 110, this has not been shown in tthe drawings for conciseness and clarity.

Also not shown for conciseness and clarity are many of the refinements which would be provided. For example, there is the electrical switch 120 for actuating the electric motor 58 which drives the chain 56. Of course the glue valve 98 could be an electrical valve electrically connected the motor 58, however, I prefer to use a manual valve.

The legs are supported by guides 122 as they pass under the staplers 74.

Therefore it may be seen that as the chain rotates, a web and two legs are fed from the supply table 18 past the glue terminals and are pressed together. As the legs pass the trigger wheel 116, it activates the staplers to staple the parts together to hold them firmly together until the glue sets. As soon as the one unit gets past the front sprocket 54, it will no longer be driven. From this point on, it is pushed forward by the channel immediately following it.

The guides 122 under long leg 14 may be clamped in one of two positions. The guide under the regular leg 12 can be permanently affixed to the main frame 16. However, the guide under the long leg 14 needs to be adjustable or be capable of being fixed in two positions: one position being for use with a regular length leg; the other for a long leg as discussed above. Also, a spacer 124 is placed on the long leg magazine 35 as needed.

The embodiment shown and described above is only exemplary. I do not claim to have invented all the parts, elements or steps described. Various modifications can be made in the construction, material, arrangement, and operation, and still be within the scope of my invention.

The limits of the invention and the bounds of the patent protection are measured by and defined in the following claims. The restrictive descripttion and drawing of the specific example above do not point out what an infringement of this patent would be, but are to enable the reader to make and use the invention.

I claim as my invention:

1. A machine for making an elongated channel having a web and two legs comprising:

a. a main frame,
b. a supply table on the main frame having a front and back with
c. a web magazine in the middle thereof,
d. two leg magazines, one on each side of the web magazine,
e. a back sprocket on the main frame behind the supply table,
f. a front sprocket on the main frame in front of the supply table,
g. a continuous chain having a top run trained around the back and front sprocket,
h. the top run under the web magazine and between the leg magazines,
i. at least three lugs on the chain,
j. each lug having three fingers, one each to engage the web and each leg,
k. a source of glue under pressure,
l. a bifurcated conduit on the main frame extend from the source of glue to in front of the supply table,
m. said conduit terminating over each leg in front of the supply table to apply glue thereto,
n. a spacer block on the main frame in front of the front sprocket,
o. two leg pressure means on the main frame, one on each side of the spacer block, for pressing the legs firmly against the spacer block,
p. a web pressure means on the main frame pressing the web firmly against the glue on top of the legs,
q. two staplers on the main frame, one over each leg at the spacer block, and
r. an air valve fluidly connected to the staplers for actuating the staplers to drive a staple through the web into the legs.

2. The invention as defined in claim 1 including all of the limitations a. through r. with the addition of the following limitations:

s. a trigger wheel having a radial face journaled to the main frame at the spacer block,
t. said trigger wheel adapted to run against a leg being fed past the spacer block,
u. two triggers extending from the radial face of the wheel, and
v. an actuator on the air valve,
w. said actuator extending over the trigger wheel so the triggers on the trigger wheel contact the air valve actuator thus triggering the staplers.

3. The invention as defined in claim 1 including all of the limitations a. through r. with the addition of the following limitations:

s. guides beneath the supply table transverse to the top run of the continuous chain,
t. arms slidingly mounted upon said guides and projecting above the supply table, thereby
u. adapted to push legs upon the leg magazines toward the web magazine,
v. a cable attached to said arms,
w. a pulley attached to the supply table on the opposite side of the supply table to which each of the arms are mounted, and
x. weights on the cable so that the weights pull the arms and thus the legs toward the web magazine.

4. The invention as defined in claim 3 including all of the limitations a. through x. with the addition of the following limitations:

y. a trigger wheel having a radial face journaled to the main frame at the spacer block,
z. said trigger wheel adapted to run against a leg being fed past the spacer block,
aa. two triggers extending from the radial face of the wheel, and
bb. an actuator on the air valve,
cc. said actuator extending over the trigger wheel so the triggers on the trigger wheel contact the air valve actuator thus triggering the staplers.

* * * * *